US011608777B2

(12) United States Patent
Devine

(10) Patent No.: US 11,608,777 B2
(45) Date of Patent: Mar. 21, 2023

(54) INTERNAL COMBUSTION ENGINE WITH FUEL COMPRESSION CHAMBER CYLINDERS

(71) Applicant: John A. Devine, Chesterfield, MO (US)

(72) Inventor: John A. Devine, Chesterfield, MO (US)

( * ) Notice: Subject to any disclaimer, the term of this patent is extended or adjusted under 35 U.S.C. 154(b) by 119 days.

(21) Appl. No.: 16/740,408

(22) Filed: Jan. 11, 2020

(65) Prior Publication Data

US 2020/0224586 A1 Jul. 16, 2020

Related U.S. Application Data

(60) Provisional application No. 62/842,299, filed on May 2, 2019, provisional application No. 62/791,577, filed on Jan. 11, 2019.

(51) Int. Cl.

| | |
|---|---|
| ***F02B 75/02*** | (2006.01) |
| ***F02B 75/12*** | (2006.01) |
| ***F02B 3/04*** | (2006.01) |
| ***F02B 75/40*** | (2006.01) |
| ***F02B 67/04*** | (2006.01) |
| ***F02B 75/28*** | (2006.01) |

(52) U.S. Cl.

CPC ..... *F02B 75/02* (2013.01); *F02B 3/04* (2013.01); *F02B 67/04* (2013.01); *F02B 75/12* (2013.01); *F02B 75/282* (2013.01); *F02B 75/40* (2013.01)

(58) Field of Classification Search

CPC ..... F02B 33/22; F02B 67/04; F02B 75/02; F02B 75/40; F02B 3/04; F02B 75/12; F02B 75/282

See application file for complete search history.

(56) References Cited

U.S. PATENT DOCUMENTS

2012/0145120 A1* 6/2012 Rohs ..... F01B 3/0005 123/204
2012/0304967 A1* 12/2012 Devine ..... F02B 41/06 123/429

* cited by examiner

*Primary Examiner* — Grant Moubry
*Assistant Examiner* — Ruben Picon-Feliciano
(74) *Attorney, Agent, or Firm* — Charles McCloskey

(57) ABSTRACT

Improvements to an engine comprise an air compressor cylinder with a piston, a combustion chamber cylinder with a piston. An engine has added an expansion chamber cylinder with a piston. Pistons each have a connecting rod and connecting rod head and associated parts adapted for reciprocating motion via combustion products, and a transmission associated with the engine. Improvements are to the piston seals, ignition assembly, valve shape and stem/rocker, valve operating mechanism, construction of head, heat management/heat shield, connecting rod/piston rotator, engine balancing, fuel pump placement, and a machining process.

20 Claims, 8 Drawing Sheets

INTERNAL COMBUSTION ENGINE WITH FUEL COMPRESSION CHAMBER CYLINDERS

CROSS-REFERENCE TO RELATED APPLICATIONS

This non provisional application claims priority to provisional application Ser. No. 62/791,577, filed on Jan. 11, 2019, and provisional application No. 62/842,299, filed May 2, 2019, which are owned by the same inventor.

BACKGROUND OF THE INVENTION

These engine improvements generally relate to a heat engine and more particularly to a Semi Continuous Internal Combustion engine.

The word engine can refer to something that is powerful, producing work which moves things forward; the word is thought to have been around before the first engines as they are typically thought of today. Usually the word engine now refers to a metal contraption that burns a fuel to produce power. The word engine has been used for the big picture idea of people working together to accomplish something and hopefully something positive and great. A word related to the word engine is ingenuity. Ingenious seems to have some commonality with ingenuity.

An engine that is efficient, combusts fuel with a minimum of emissions, one useful in lower range power requirement applications, and creates a low volume of noise were the design goals. Possible engine idea improvements were thought of and the design developed to a degree with a study prototype constructed. And in addition another engine idea was thought of and also the design developed to a degree. Engines are machines with many parts and many functions to accomplish together; if any part is not working properly the function of the entire engine is compromised. Much thought, work and research has been done to start the process of developing the engine concepts. In addition to the engine ideas there is a wide range of materials that are available today to construct the engines out of. There is a lot of technology that is useful to the design and construction of the engines.

An engine is very complex and a new engine technology it seems would need to be proven for most people to actually know if the new design is beneficial and an improvement over existing technology. An issue is it is a very costly experiment to create a new engine technology from nearly scratch. Many of the people, organizations and resources that are able to create this kind of experiment are very busy and focused on improving the current technology. A new engine would need to first run which means that it actually fires up and the engineering be sound enough to stand up to producing power. This will take a number of attempts of building better and better parts and putting them together in prototype engines with learning at each step. Then a new engine needs to be more efficient than current engines. A new engine needs to make advances in addressing emissions issues. Then it needs to be cost effective to manufacture. The size to power ratio would need to be manageable. The power to weight ratio needs to be manageable. If a new engine was able to deliver the above, it would seem that it would be welcomed. This kind of technology has the potential to be disruptive and be called disruptive technology so it will generate concern in certain people. There are certain risks in attempting the construction of a new engine technology.

DESCRIPTION OF THE PRIOR ART

Engines come in many forms. Coal powered electrical generation plants have efficiency in about the 30s percentage range. Gasoline 4-cycle heat engines typically have an efficiency in about the 20s percentage. Large diesel engines have efficiencies as high as around 50s percentage. Jet plane gas turbine engines have efficiency in about the 30s percent range. Gas turbine electrical generation engines with a cycle similar to the Brayton cycle with a water boiling regenerator are reported to be about in the 50s percent efficient range. A typical alternator in a car is about 60 percent efficient. AC electric motors for electric automobiles are in the high 90s percent range efficiency. A turbo charger or supercharger fan in a typical car approaches efficiency in the high 70s percent range.

The steam engines typically produce power by the following process. Fuel is burned in a fire box. The hot combustion products are channeled typically through pipes in a heat exchanger/boiler with water surrounding the pipes which heats and boils water to steam. Modern piston steam engines have the combustion gases flow around a stainless steel tube that has water/steam inside the tube to be used to power the engine, this allows for a quicker reaction time in generating steam. Pressurized steam is channeled to pistons or double acting pistons through a valve mechanism to drive the pistons. This piston rod mechanism is connected to a crank producing rotational force. In latter steam engine designs a compound two piston arrangement with a high pressure chamber and a low pressure chamber was used to increase efficiency and smooth out the power output, there have even been triple expansion engines. A steam engine has high torque throughout its rpm range.

But, the external combustion has to transfer its heat through a material to boil the water, this transfer of heat is not complete therefore much heat energy is exhausted to the atmosphere in the combustion exhaust. Much cooling medium is required to cool the engine exhaust steam back to condense to water. The loss of this heat is another loss of heat energy. Without a steam exhaust condenser, a large amount of new water is required for boiling. Modern steam engines condense the exhaust steam to minimize new water requirements.

Then the 2-cycle engines typically produce power by the following process. Air is pulled into a crank case through a valve(s) in the compression stoke of the piston by a vacuum created under the piston and then as the piston moves back down the air is compressed enough to be channeled into the combustion chamber at the end of the combustion stroke. This fuel/air mixture is compressed in the compression stroke and combusted when the piston reaches the top of the chamber. The piston is driven down by combustion and the power is transferred to a crank by a connecting rod. The exhaust exits the chamber at the end of the combustion stroke as the intake fuel/air is channeled into the chamber. In some engines the fuel is injected directly into the combustion chamber as the piston is compressing the fuel/air mixture.

But, lubrication is usually accomplished by a fuel/oil mixture which adds to the exhaust containing excessive emissions. Combustion is not complete because of the minimal time of combustion and below combustion temperature chamber and piston. The chamber does not get cleared of all exhaust; there is a mixture of exhaust without oxygen that gets mixed with the incoming fuel/air which impedes the combustion process.

The 4-cycle engines generally produce power by the following process. A piston moves down a chamber usually causing a vacuum, (unless the engine has forced air injected into the chamber via a turbo charger or supercharger then the air is pressurized), in which air and in many engines fuel/air mixture moves through a port into the chamber in the intake stroke. This mixture is compressed as the piston moves up the chamber, when the piston reaches about the top of the chamber the fuel/air mixture is ignited and combusted. This combustion drives the piston down. The power of the piston is transferred to a crank through a connecting rod. When the piston is near BDC the exhaust valve opens and the exhausts exits, the last of the exhaust is mostly push out of the chamber by the piston through a port as the piston moves up the chamber.

The 4-cycle engine has become very complex to meet efficiency and emission standards. Fuel enters a 4-cycle engine in many ways to mix with the air. Many engines have a butterfly valve that is moved to regulate the flow of air into the engine.

Carburetors utilize the air flow into an engine. The air flows through a venturi in a carburetor and fuel is introduced at the venturi, a float maintains a fuel level so a proper amount of fuel is mixed with the air to maintain a proper fuel/air mixture. Fuel injectors inject fuel into the air intake manifold before the intake valve and a computer regulates the fuel flow with input from sensors and the throttle. Direct injection injects fuel directly into the combustion chamber. This is a high pressure injector and requires additional parts such as a high pressure fuel pump. The injector injects fuel as a piston is drawing in air or at the time a piston compressing the air or right before the piston is near TDC.

But, a 4-cycle engine draws in air through a heated head, heated intake valve, into a heated cylinder wall and heated piston. These surfaces heat the intake air making it harder and less efficient to compress the hot air/fuel mixture. The surfaces that the intake air comes in contact with are heated up not only by the compressing air but also by the combustion heat that heated up the surfaces including the valve surfaces. A thought is that when the air is compressing that the compressed air temperature rises above the temperature of the surfaces of the chamber walls due to the air's compression.

Intake air is restricted to create the best fuel/air ratio for the amount of power the engine needs to generate. This creates a vacuum slowing the engine down as the piston pulls on this below atmospheric pressure air, this is not efficient. Although the work energy to compress the air is less because of reduced air pressure. The internal resistance per rotation of an engine is nearly the same at a range of power output so at low power outputs the ratio of power output to internal resistance becomes higher and the overall engine has less efficiency. The compression ratio is effectively lowered because of the restricted air leading to a lower less energetic combustion temperature and the efficiency also lowers.

The combustion chamber has a space at the top that does not fully push the exhaust gasses out so when the piston starts its intake cycle the exhaust gasses expands making the intake process less effective. This also mixes with the incoming fuel/air mixture which reduces clean combustibility.

Engines often have a combustion chamber. In a 4-cycle engine there is a boundary layer at the cylinder walls, head and top of the piston that is below combustion temperature so the fuel/air mixture in this area does not combust. This layer is thin but there, coolant is pumped around the cylinder walls and head at about 220 degrees F. to keep these parts and their surfaces below a temperature that the oil minimally breaks down.

One of the means the piston cools is by transferring heat to the cylinder walls through a thin layer of oil. Oil is typically pumped through the crank shaft, connecting rod, a pin, piston then through an oil ring. In some cases, oil is sprayed on the bottom of the piston.

Displacement per revolution is one factor in the power output of an engine, the RPM rounds per minute is also a part of the equation of how much fuel an engine can burn and produce work horse power. Many 4-cycle engines with the conventional crankshaft can operate at high RPM's so their displacement over a time period is significant. One cylinder of a 4-cycle engine only draws in air for half of a complete round of the crank shaft and on every other turn of the crank shaft so only 25% of the time is each cylinder actually drawing in air to mix with fuel to burn so it would take a four-cylinder engine to always be drawing in air. Displacement of an engine is typically measured the total of all the cylinders. In a typical crank shaft engine, the piston spends 50% of its time coming to a stop and the other 50% starting from a stop and to moving as fast as it will so the average speed of the piston is actually what matters in the displacement multiplied by time equation. So this constant speeding up and coming to a stop per stroke cuts the average speed down. Engines differ in their piston stroke but a measurement that is used is 3.44". If the engine is turning at 1,500 RPM times 6.88" for the full movement up and down it is moving 10,320" in a minute so times 60 or 619,200" in an hour, divide 619,200" by 12 to get to feet equal 51,600 feet and divide 51,600 feet by 5280 feet is 9.77 so this is the average miles per hour. The top speed of the piston at 1,500 RPM is about 15.3 miles per hour.

SUMMARY OF THE INVENTION

This invention has an air compressor cylinder with a piston, a combustion chamber cylinder with a second piston, a port connecting and communicating with the two cylinders, the pistons having connecting rods and connecting rod heads, two fuel compressor chamber cylinders each with a third piston that move oppositely, and two additional fuel compressor chamber cylinders each having heads mutually linearly offset wherein each head has a location near its corresponding combustion chamber cylinder head to which it pumps fuel. Further the pistons and connecting rods move linearly. The third pistons also move linearly and for the same length of motion as their connecting rods and connecting rod heads of the other two pistons. This improved engine utilizes Semi Continuous Internal Combustion, or SCIC. Additional features of the invention will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and devices for carrying out the several purposes of the present invention. It is important, therefore, that the claims be regarded as including such equivalent constructions insofar as they do not depart from the spirit and the scope of the present invention.

It is therefore an object of the present invention to provide a new Improved Engine that may be easily and efficiently manufactured and marketed to the consuming shops, teams, suppliers, parts houses, and the public.

Another object of the present invention is to provide an Improved Engine utilizing Semi Continuous Internal Combustion, or SCIC.

Still another object of the present invention is to provide an Improved Engine that ignites a fuel and compressed air mixture.

Still another object of the present invention is to provide an Improved Engine that reduces fuel consumption at least 5% for a given horsepower.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

In referring to the drawings.

The same reference numbers typically refer to the same parts throughout the various figures.

DESCRIPTION OF THE PREFERRED EMBODIMENT

Figure 1:
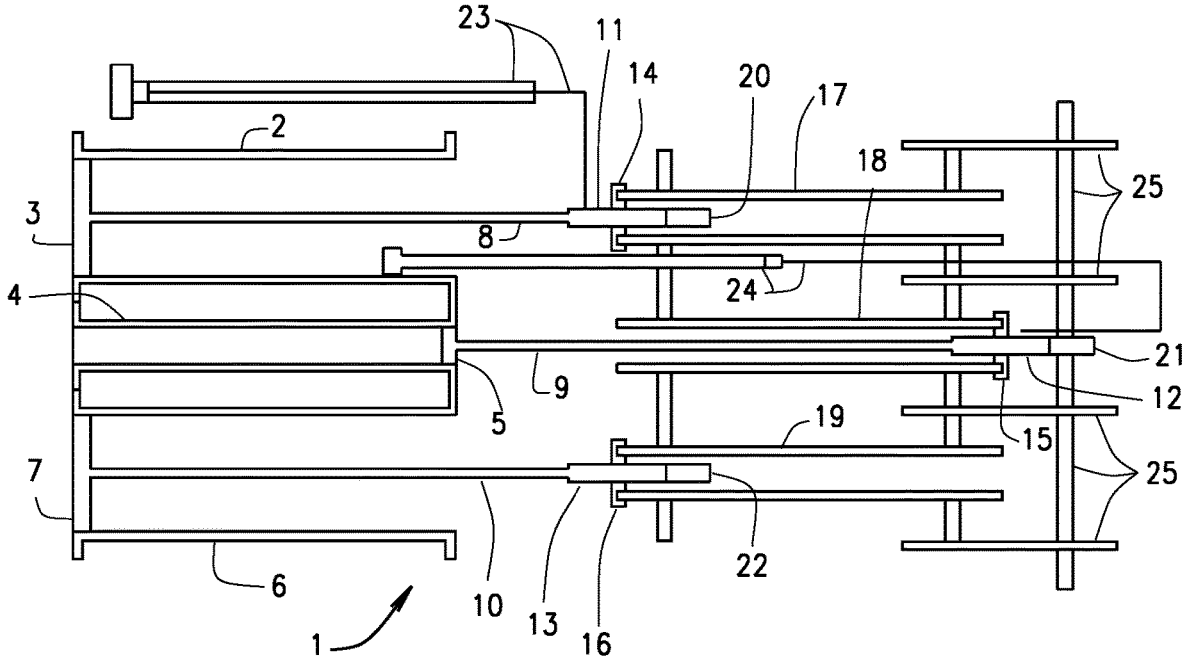
FIG. 1 shows a plan view of conceptual engine.

Referring now to the drawings, and particularly to FIGS. 1-16, a preferred embodiment of the Improved Engine of the present invention is shown by the reference numeral 1. The engine 1 generally ignites a fuel and compressed air mixture. This engine utilizes a Semi Continuous Internal Combustion, or SCIC.

An Engine Embodiment

FIG. 1 shows an engine 1, it has an oxidant source which is preferred to be air compressor chamber cylinder 2 with a piston 3, the engine has a combustion chamber cylinder 4 with a piston 5 and the engine also is preferred to have an expansion chamber cylinder 6 with a piston 7. There is a port between the air compressor chamber cylinder and the combustion chamber cylinder (not shown), if there is an expansion chamber there is also a port from the combustion chamber cylinder to this expansion chamber cylinder. Each piston has a connecting rod 8, 9, and 10 and a connecting rod head 11, 12, and 13 that move in a linear motion. Each connecting rod head is operatively connected to a crank mechanism by way of a connector 14, 15 and 16. Each crank mechanism is preferred to be inexhaustible continuous loop (chains) 17, 18 and 19, preferred is a counterpart chain as shown on the other side of each connecting rod head. Each chain spans between two rotating components (sprockets), (not shown). Connecting rod heads have added weight as needed to balance the engine 20, 21 and 22. In some engine configurations connecting rod heads have connections to a fuel pump connecting rod to a piston associated with a fuel pump chamber cylinder with a head 23 and 24. Dual acting pistons in chamber cylinders with duel heads are preferred. Fuel injection and combustion is preferred to occur over a period of time, fuel is introduced into the combustion air in many possible ways, it is preferred in an engine that has a combustion chamber cylinder and a expansion chamber cylinder that fuel injection ramps up as the combustion chamber cylinder piston moves down its stroke away from its associated air/fuel injection nozzle, fuel injection and combustion may occur at or near BDC of the combustion chamber cylinder piston stroke, combustion may occur even as this piston is moving past BDC back toward the combustion chamber cylinder exhaust valve. The drive shaft 25 has chains and sprockets operatively connected to the crank mechanism's sprockets to maintain the timing of all the components.

Pistons and Piston Seals

This piston/chamber cylinder sealing mechanism has use for combustion chamber cylinder pistons, expansion chamber pistons, air compressor pistons, or pistons for other uses. Each piston has a connecting rod and connecting rod head and associated parts which all cycle in a linear motion. Just the piston seals are meant to contact the chamber walls.

Figure 2:
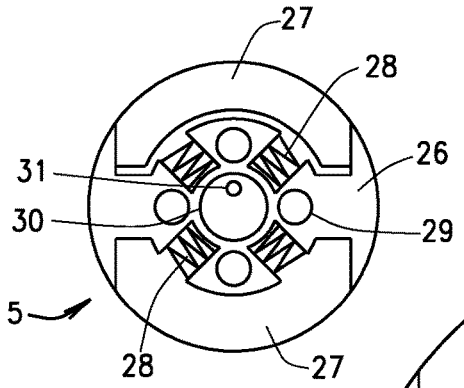
FIG. 2 shows a sectional view of a piston seal retainer and seals.
Figure 3:
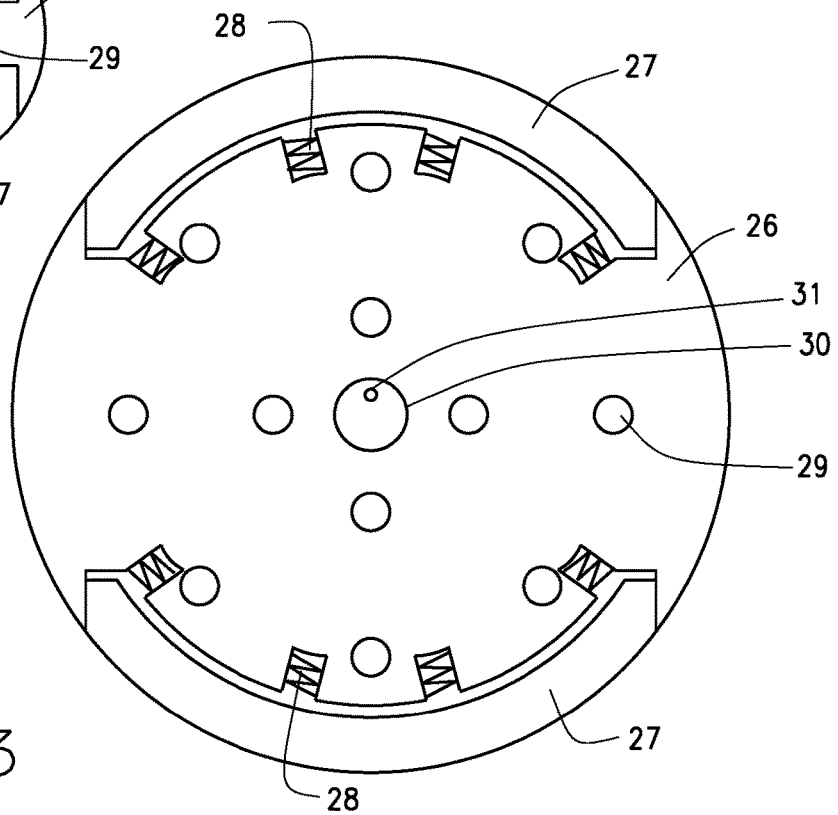
FIG. 3 has a sectional view of a piston seal retainer and seals.

FIG. 2 shows a combustion chamber cylinder piston 5 as previously shown in FIG. 1. FIG. 3 shows a piston, in which at least one use is an expansion chamber piston 7 from FIG. 1, or air compressor piston 3. The seals are a high temperature withstanding material, not requiring typical oil lubrication, carbon based seals with potentially integrated or plated compounds are preferred. Preferred is a piston that has two seal retainer plates. A seal retainer plate 26 retains two seals 27, one on each side. Another seal retainer is placed next to this seal retainer and is turned preferably 90 degrees. The seals of the different retainer plates overlap at their ends. The seal retainers are between outer piston face plates, these plates hold the outer side of the seals. The seal retainer holds the inner side of the other seal retainer seals. The seal retainer holds a seal between two parallel or nearly parallel surfaces to contact the parallel or nearly parallel surfaces of the seal ends. The seal outer edge matches the roundness of the inner surface of the chamber cylinder. There is a means to maintain the seals outward against a chamber wall, a flexible member such as springs or expanding wedges 28 are placed between the seal retainer and the seal. The outer face plates and the seal retainers are attached together by a preferred method of screws 29, the screws are welded to prevent loosening. As an alternate to multiple plates the piston/seal retainer structure may be cast/machined out of a one or more pieces. There is a threaded connection of the piston outer plate(s) and seal retainers to the connecting rod 30, a set screw 31 is placed through the piston outer plate into the end of the connecting rod is to prevent the connecting rod from unscrewing.

Ignition Assembly

Figure 4:
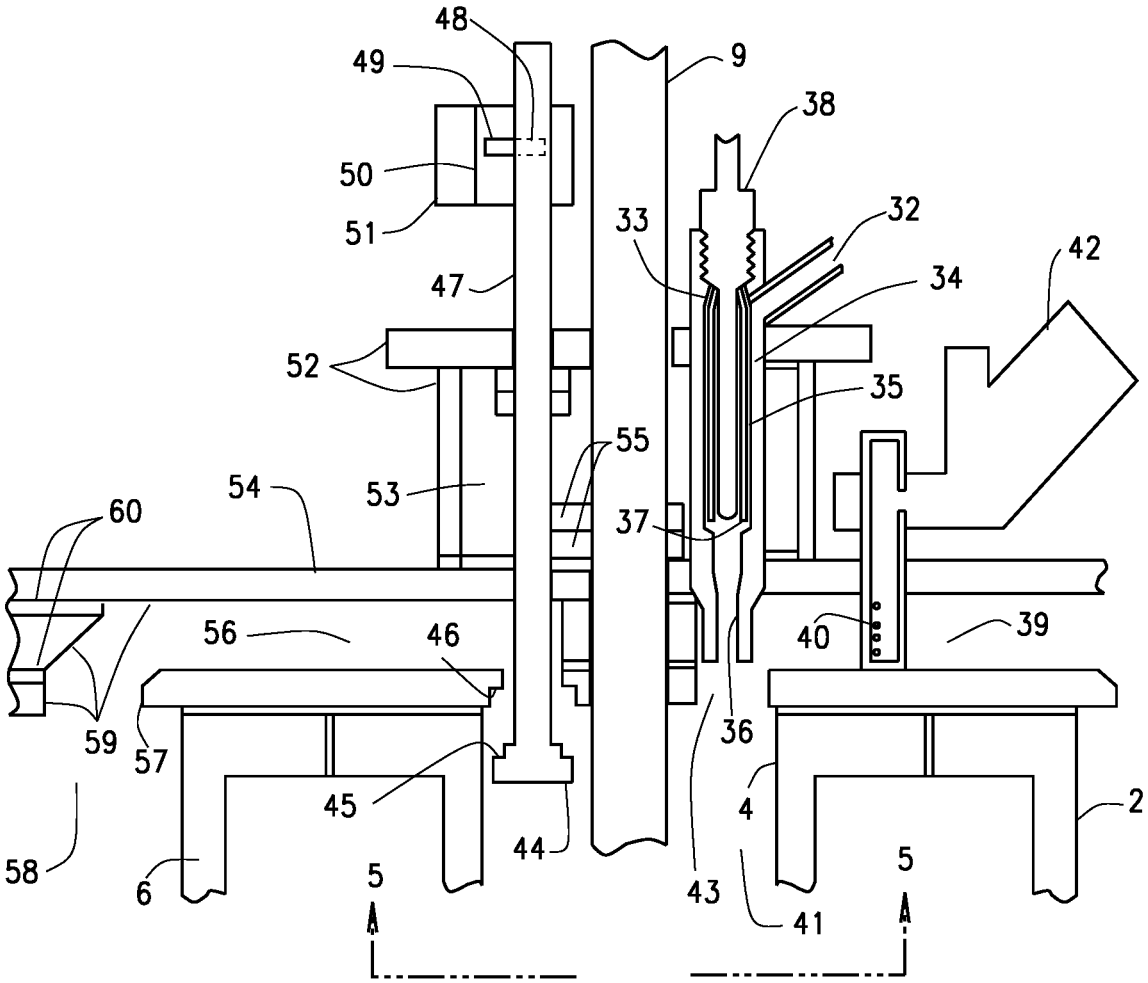
FIG. 4 shows a partial sectional view thru an ignition assembly.

FIG. 4 is a section through part of an ignition assembly. Igniting air/fuel mixture moving at a high velocity in a cool engine is a challenge. A preferred way is an igniting burner supplied by an electric motor powered air/fuel pump to compress a combustible mixture 32 into a channel 33 between an ignition burner housing around an inner tube 34 in the housing. This inner tube forms along with grooves 35 in the ignition burner housing, channels for a combustible air/fuel mixture to be injected into an igniting burner combustion area 36. An ignitable mixture is injected into an igniting burner chamber at 37 near the end of a glow plug 38, (alternatively a spark plug can be used) for ignition. In the engine configuration utilizing two combustion chambers an air/fuel pump with two separate piston pumps turned by one electric motor has benefits, each piston pump supplies a compressed air/fuel mixture to a combustion chamber ignition burner.

Air is injected from the main engine air compressor chamber cylinder through an air port 39 past fuel line and fuel injection nozzles 40 to mix with the air to generate a combustible mixture to be injected around the housing of the ignition burner chamber and through the exhaust and flame of the igniting burner thru nozzle 43 into the combustion chamber 41. There are benefits to utilizing a fuel control valve 42 at the supply fuel port/line to the fuel injection nozzles 40 from a fuel pump for the purpose of controlling the timing of the fuel injection also it may control the mass of the fuel injection, but this fuel control valve is not required. An engine that has a fuel pump that pumps fuel in a gas form that has a fuel pump chamber cylinder volume relative to the air compressor chamber cylinder volume in an optimal air/fuel ratio allows the air/fuel to be mixed and injected into the combustion chamber. The stroke time of the air compressor piston and the fuel pump piston may be similar. The power output of the engine may be controlled by limiting the fuel that the fuel pump draws in and then when the fuel pump starts to compress the fuel and the fuel pressure reaches the air pressure from the air compressor the fuel will move into the air and create a combustible mixture to flow past the igniting burner and combust. Depending on how much fuel is allowed into the fuel pump, combustion will start anywhere from the beginning of the combustion stoke to near the end of the combustion stroke. When the temperature of the chamber cylinder walls is above a combustion ignition temperature the igniting burner is not required to operate, also it is possible to only require this igniting burner to operate during the cycle time that fuel is being injected, in which there would be an igniting burner air/fuel control valve. If a liquid fuel is used, a similar principle of the described fuel in a gas form fuel pump may be used, the volume of the fuel pump chamber for an optimal air/fuel is less. If a liquid fuel is used another method of pumping it to pressure may be used to supply fuel to a fuel injector and associated mechanism to inject fuel into the air.

Non-Concentric Valve

A non-concentric valve is developed to allow a reasonable amount of open area for gasses to flow thru an open valve, especially in a high temperature environment in the end of a small diameter chamber cylinder. The high temperature requires a relatively large valve stem which interferes with the flow of gasses thru a small valve opening. This non-concentric valve with an optimal shape and minimized stem interference improves the flow of gasses. A valve/integrated stem moves linearly. This non-concentric valve and associated parts has use in other applications.

FIG. 4 shows in addition to an ignition assembly a section through a non-concentric poppet valve 44, it has a valve stem 47, the valve stem has a hole 48 for the insertion of a pin 49 and a rocker 51 with a slot 50 to maintain the valve stem in a non-rotational linear movement. An alternate is the valve 44 has more than one valve stem which would maintain the valve in the correct rotational position as they move linearly. The valve seat 46 and valve bearing surface 45 is flat or angled. Housing 52 holds a structure 53 which is a connecting rod guide and a valve stem guide, and it maintains the air/fuel ignition burner/valve. The material of structure 53 is preferably a carbon based material. The structure's material includes stainless steel, a stainless steel alloy, or plating of steel and nickel, a high temperature nickel based super alloy, such as Inconel® of Huntington Alloys Corp. of Huntington, W. Va., and silicon carbide. This structure 53 holds the valve stem seal. The connecting rod 9, which is shown in FIG. 1 and its seal 55, on the other side of the engine does not have these components. The expansion chamber is 58. The exhaust port from the combustion chamber cylinder to the expansion chamber cylinder is 56. The opening from the port into the expansion chamber is 57. Plates 59 have a flexible gasket material 60 between the plates. The air compressor chamber cylinder is 2. The combustion chamber cylinder is 4. The expansion chamber cylinder is 6.

FIG. 4 additionally shows a partial section thru the engine head with plates 59, between these plates is a flexible gasket material 60 which is preferred to be a graphite stainless steel composite or graphite. This engine is designed to operate at a high temperature, high temperatures generated on one side of a head can warp and crack typical heads. The head(s) for this engine is constructed in layers out of a material that has structural integrity at high cycling temperatures with a high temperature capacity gasket material between the layers. The material of the edges of the gasket in high temperature high velocity flowing gasses benefit from being hardened by a method like wrapping the edge with a heat tolerant material. Another way to protect the edge of the gasket material is cut a grove in the plates at the edge to place a rod between the plates to press into each plate. Layering of plate material is used for managing the temperatures and for ease of construction, studs and bolts of a high temperature withstanding material are used, an anti-seize may be used at the nuts. The shape of the plate layers provides structure and openings in the layers form the ports.

Figure 5:
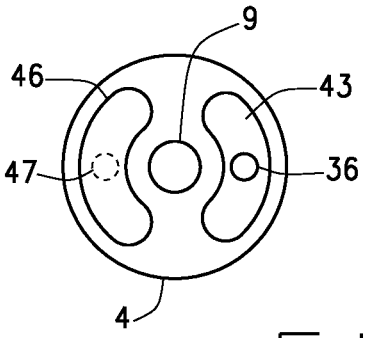
FIG. 5 shows an end view of a non-concentric valve.

FIG. 5 shows the shape of this particular non-concentric poppet valve 46, the valve stem behind the valve 47. The combustion chamber cylinder 4 interior surface. This FIG. 5 is showing an ignition assembly air/fuel mixture nozzle 43 with an ignition assembly igniting burner 36, a piston connecting rod 9, which is shown in FIG. 1.

Figure 6:
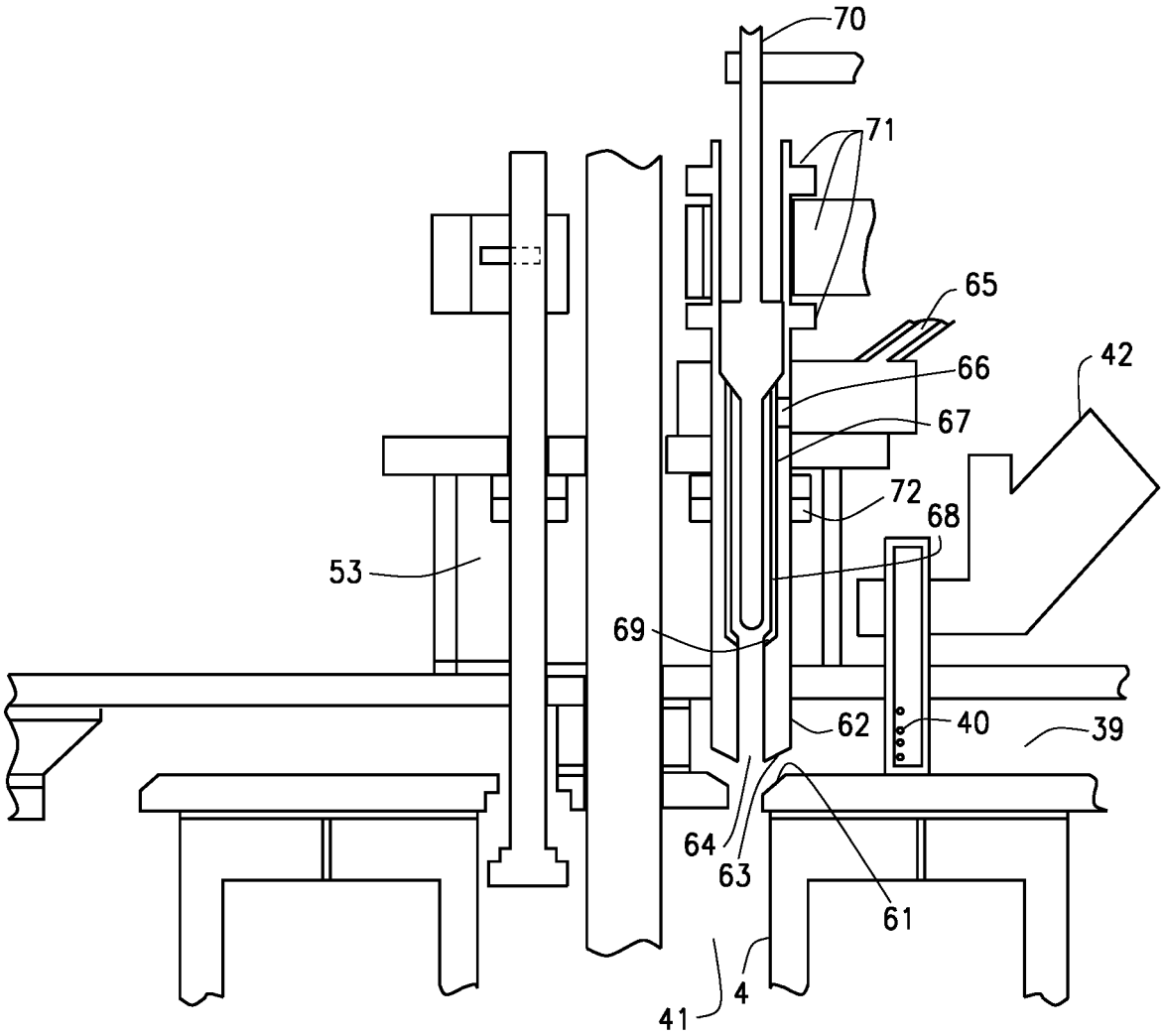
FIG. 6 has a partial sectional view thru an ignition assembly with a combustion chamber cylinder injection valve.

FIG. 6 show a section thru part of an ignition assembly similar to FIG. 4 but with an operative air/fuel injection valve between the air port 39 and the combustion chamber 41. An engine may have a multiple of these injection valves. Shown is a valve 62 with a valve seat surface 63 and valve seat 61. A valve ignition burner chamber 64. A preferred way is an igniting burner supplied by an electric motor powered air/fuel pump to compress a combustible mixture into a connector 65 to a channel 66 between an ignition burner housing and around an inner tube 67 in the housing. This inner tube forms along with grooves 68 in the ignition burner housing, channels for a combustible air/fuel mixture to be injected into an igniting burner combustion area 64. An ignitable mixture is injected into an igniting burner chamber at 69 near the end of a glow plug 70 for ignition. Valve 62 has a valve operating mechanism 71. Valve seals 72 maintained in position by material 53.

Valve Operating Mechanism

This valve operating mechanism has use for combustion chamber cylinders, expansion chamber cylinders, air compressor chamber cylinders, or chambers for other uses. In an engine that has a long piston stroke the percentage of time the valve movement decreases so the dwell time of a typical cam based valve operation mechanism increases, its size, speed of valve movement and friction cause issues. This new valve operating mechanism minimizes friction and optimally manages valve movement.

Figure 7:
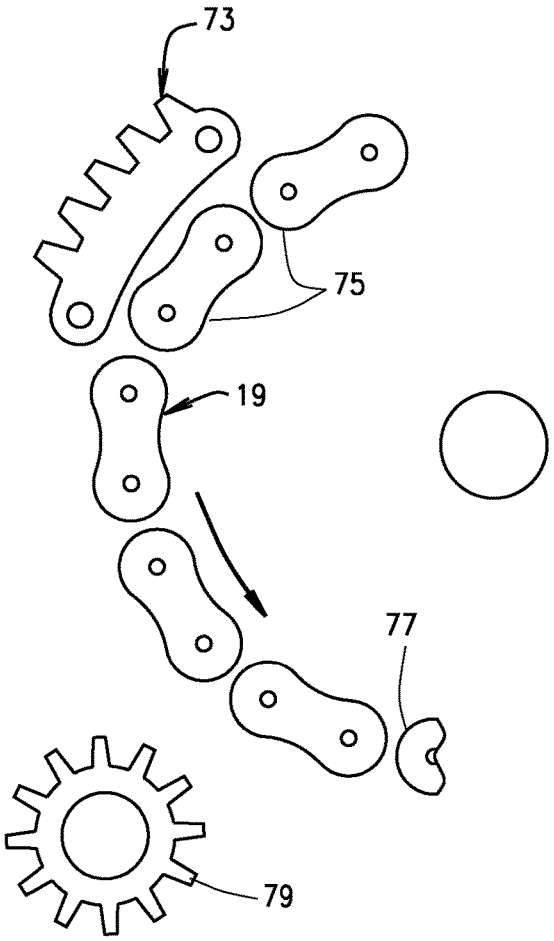
FIG. 7 shows a side view of part of a valve operation mechanism.
Figure 8:
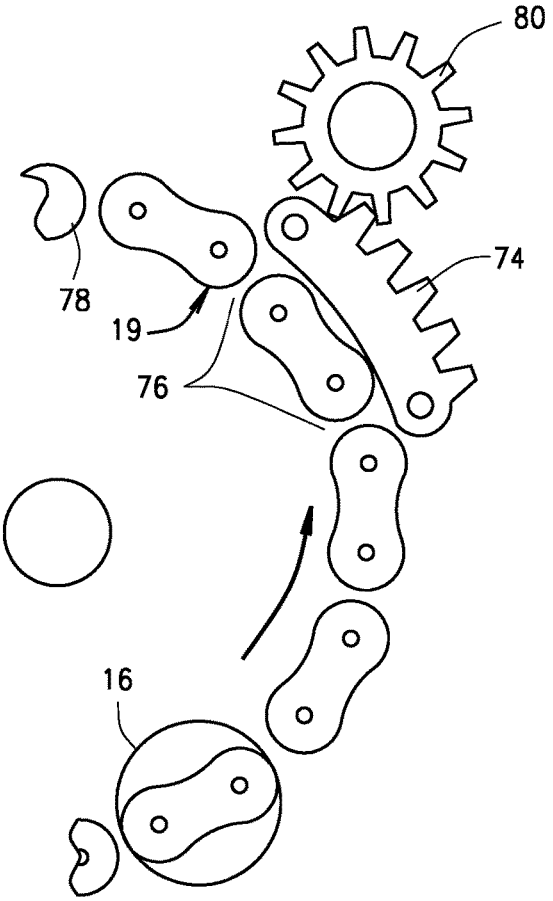
FIG. 8 shows a side view of part of a valve operation mechanism.
Figure 9:
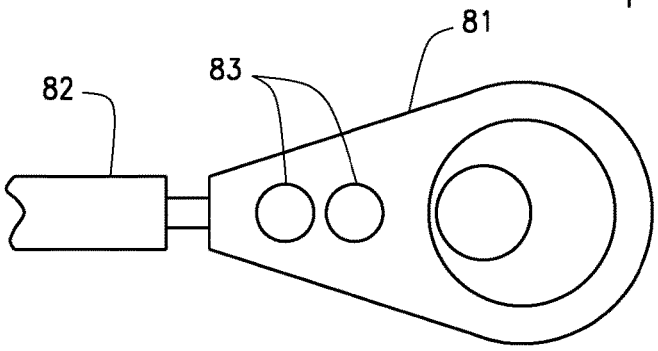
FIG. 9 has a side view of a valve operation mechanism valve crank.

FIG. 7 is an elevation of a part of the valve operating mechanism showing a valve gear segment 73 to open a valve near or at bottom dead center piston. On the opposite side of the chain there is another gear segment 74 to close a valve before top dead center of a piston. The bottom dead center and the top dead center are on the active face of the piston in the chamber. These gear segments are connected to chain 19 as shown in FIG. 1 or another chain. Each gear segment is preferably mounted to two different links of the chain 19 at 75 and 76, a way to effect this is each side plate of each of chain link extends up with a hole in each plate for a connector for one of the connections to the gear segment. The chain 19 is on and between chain sprockets 77 and 78. The chain and sprockets are shown moving counter clock wise. There is a connecting rod crank head connector 16 as shown in FIG. 1, preferably attached to and between two different chains with two sprockets each and has a rotatable connection to a connecting rod crank head. A valve gear 79 is turned 180 degrees upon the engagement of a valve gear segment 73 and 74. If an engine has dual acting pistons, multiple valves per chamber cylinder such as intake and exhaust valves or multiple chamber cylinders it may have valve gear 80, which is turned 180 degrees upon the engagement of a valve gear segment(s) 74 and 73. The gear 79 turns a valve crank and connecting rod end 81 as shown in FIG. 9. The valve gear 80 turns a different valve crank (not shown) similar to valve crank and connecting rod end 81. The valve gears 79 and 80 are located on the opposite sides of the centerlines of the chain connecting sprockets 77 and 78. The 180-degree movement of each valve gear effect the movement of each respective valve crank and connecting rod end to move their respective valve connecting rods. Valve gear 79 is connected to valve crank and connecting rod end 81 through a shaft mounted in a bearing housing, this bearing housing location is adjustable to perfect the meshing and timing of the valve gear segment with the valve gear, this crank may be directly attached to the gear even integral. It is preferred valve gear segment 73 and 74 each have a shock absorbing connection to their respective chain links to minimize the stress of the gear meshing. A flexible material bushing(s) connection or the valve gear segment or chain connection having a sliding groove with a flexible member shock absorber. Valve gear 80 is similarly connected to its valve crank and connecting rod end and support mechanism. An alternate to the chain and sprockets are a gear belt and gear pulleys, an inexhaustible loop and rotating component.

FIG. 9 is an elevation of a valve crank and connecting rod end 81, which is operatively connected to valve gear 79, this valve crank and connecting rod end when turned moves the valve connecting rod 82. In certain engines there is a counterpart valve crank (not shown) operatively connected to valve gear 80. Two dimple's 83 are placed in each valve crank connecting rod end to maintain the positions the valve crank in the forward or back position. Preferred is a spring loaded hollow bearing at each valve crank housing to roll into one of the dimples at a time.

Figure 10:
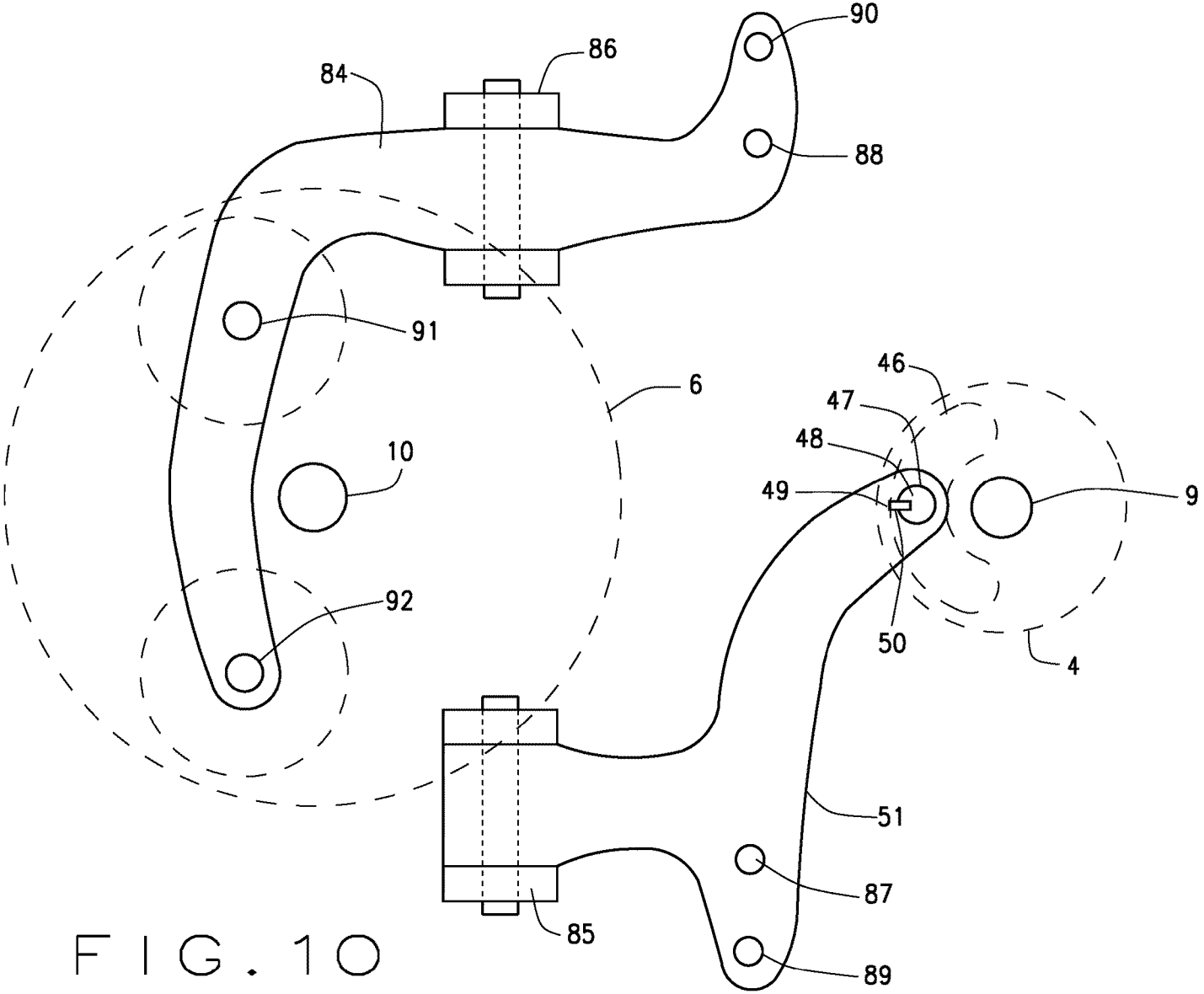
FIG. 10 shows an end view of the rockers of a valve operation mechanism.

FIG. 10 is showing the valve rockers. Connecting rod 82 as shown in FIG. 9 connects to rocker 51 shown in FIG. 4 at connection 87. A connecting rod (not shown) connects to the counterpart valve crank and connecting rod end (not shown) associated with valve gear 80, and to rocker 84 at connection 88. The combustion chamber exhaust valve rocker is 51, this valve rocker 51 connects to the combustion chamber exhaust valve stem 47, at 48, 49 and 50. If the engine has an expansion chamber it has valve rocker 84, this valve rocker connects to the expansion chamber exhaust valve(s) 91 and 92. The valve rocker 51 supporting structure is 85. The valve rocker 84 supporting structure is 86. If the engine is dual acting the connection of connecting rods between sides of an engine is 89 and 90. The opposite side of the engine would have rocker(s) (not shown) and they would be flipped, the rocker with the combustion chamber exhaust valve stem connection is mated with the rocker with the connection to the expansion chamber exhaust valve(s) on the other side and vice versa. The combustion chamber connecting rod is 9. The expansion chamber connecting rod is 10.

An air compressor chamber cylinder is preferred to utilize one-way spring loaded valves for the intake and exhaust because of simplicity but a similar or the same valve operating mechanism shown in FIGS. 7, 8, 9 and 10 and described may be used to operate air compressor valve (s)/valve(s) which has benefits in increased air flow, the exhaust valve is preferred to move away from the piston top surface in the opening movement, similar to a one-way valve motion.

The timing and operation of the valves and valve mechanisms is per engine design. An engine with an ignition assembly valve(s) at the combustion chamber may be operated by an extension from the expansion chamber exhaust valve rocker(s) connected to a lever connected to the valve stem.

Engine Balancing

Figure 11:
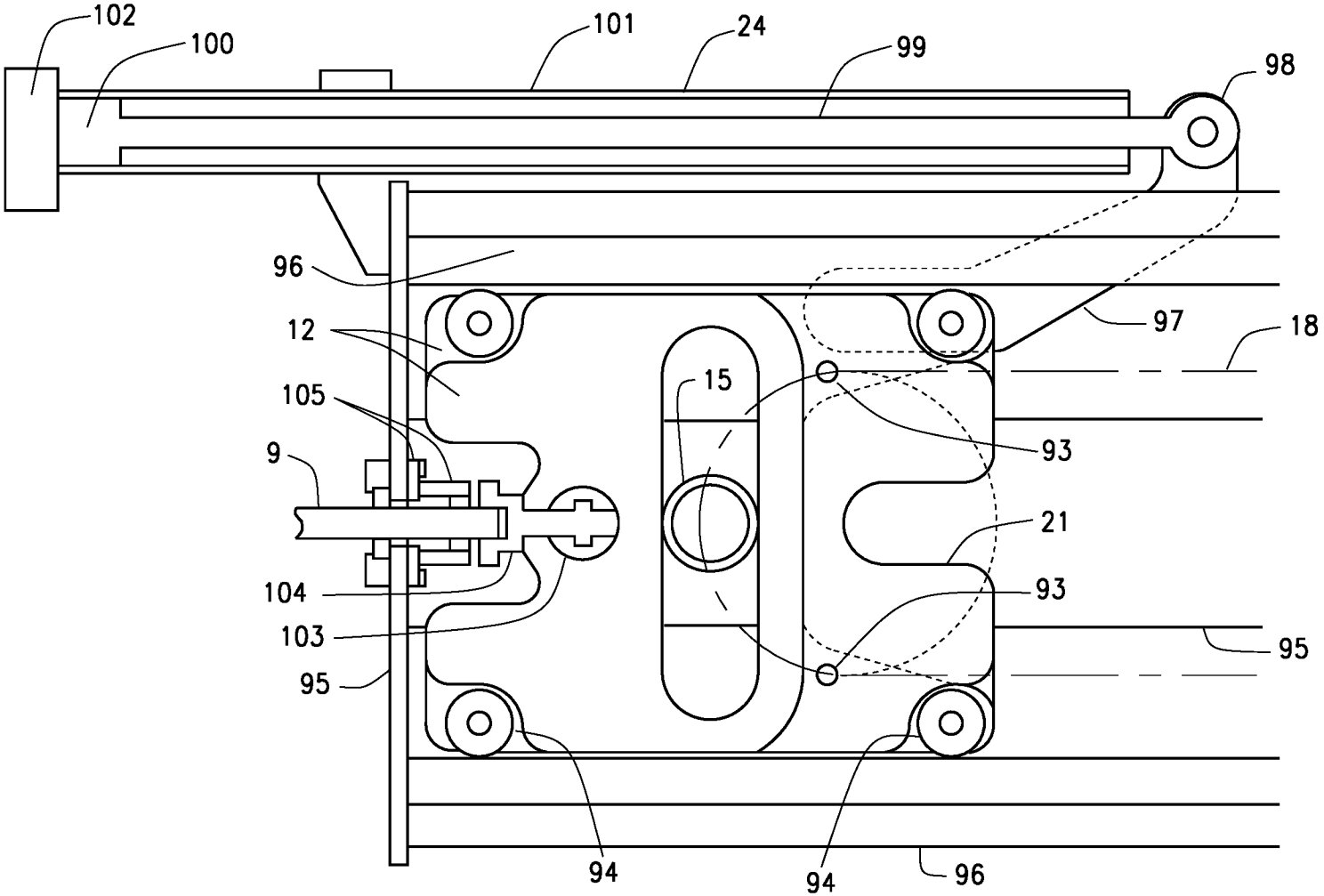
FIG. 11 shows a side sectional view of a connecting rod head with weight attachment and connector to fuel pump.

FIG. 11 shows a connecting rod head 12 as in FIG. 1. The connecting rod head 12, shows attachments 93 for weights 21. Connecting rod heads 11, 12 and 13 have potential weight attachments. Engines turn at high rpms which make balancing important to reduce issues with vibration. A preferred engine configuration has three pistons/connecting rods/connecting rod heads and associated parts. The center piston 5/connecting rod 9/connecting rod head 12 and associated parts move in an opposite phase as the two outer pistons/connecting rods/connecting rods heads and associated parts the opposite moving masses counter act each other balancing out the operating engine. Preferred is the two outer assemblies are equal in weight and together equal the weight of the center assembly, the distances apart of the parallel moving pistons, connecting rods, and connecting rod heads are equal, weight is added or incorporated into the design of the assemblies. The weights and distances apart of the assemblies can vary and use a more complex combination of weights and distances apart and still achieve a balanced operating engine. Attachment point bolt holes integrated into the connecting rod heads facilitate adding weight for fine tuning of the balancing. Consideration of the weights of fuel pump(s) piston(s), connecting rod(s) and connecting rod(s) connector(s) to the engine piston/connecting rod(s) head(s) is included in overall engine balancing. The end of a stroke of the air compressor piston requires the most work due to the highest pressure compressing air into a combustion chamber building in pressure, the slowing down of the assemblies and weights at the end of the stroke along with the connecting rod crank head connection going around the last 90 degrees facilitates transferring energy of the slowing down into compressing air. The centerline of a chain as at 18, shown in FIGS. 1, 11, connects to a sprocket.

Fuel Pump Offset

In an engine, matching the relative volume/mass of the air compressed to the volume/mass of fuel compressed to be injected and mixed in the combustion chamber port(s)/combustion chamber in the optimal air/fuel ratio has benefits facilitating reaching a constant optimal air/fuel mixture in a dynamic pressure and mass movement environment. To have the head of each fuel compressor near the combustion chamber head/fuel ignition assembly it injects fuel into facilities the air port and fuel port/line being a volume/shape to better accomplish a continual optimal air/fuel mixture being injected during combustion. Fuel pump locations are shown in FIG. 1 at 23 and 24 which shows their offset. They may be placed in line with the air compressor cylinder or combustion chamber cylinder connecting rods but are shown to the side for drawing clarity. Fuel pumps 23 and 24 each has its head near its respective air/fuel injection assembly. Fuel pump 24 shows its head 102 in FIG. 11. A connector 97 is between the connecting rod head 12 and the fuel pump connecting rod end connector 98. The fuel pump piston 100 has connecting rod 99 with an end connector 98. The fuel pump chamber cylinder is 101. Each fuel compressor has the same stroke as the air compressor piston or the combustion chamber cylinder piston, and the fuel compressor piston/connecting rod is connected to the air compressor connecting rod head by a connector. The locations of the fuel compressor heads are offset to be close to their respective combustion cylinder head, the connecting rod and/or connector of one of the fuel compressors is longer than the other to accomplish this objective.

FIG. 11 shows a connector 104 at the connecting rod head end of the connecting rod 9. The connecting rod end is threaded and screws into the connector 104 for an adjustability in length. A collar is placed around connector 104, or a portion of it, that has slots in the side so that the collar is able to tighten down to secure the connecting rod from turning in the connector yet the connector has a connection to a pin 103 that allows the connector to turn. The pin 103 is able to rotate in the connecting rod head to minimize a moment arm on the connecting rod. The connecting rod rotator is 105. The connecting rod head 12 has guide wheels 94 that move on one or more rails 96. The connecting pin between chains is 15. A structure in the engine is 95 and may have the form of a plate perpendicular to one or more of the rails.

Connecting Rod/Piston Rotator

Figure 12:
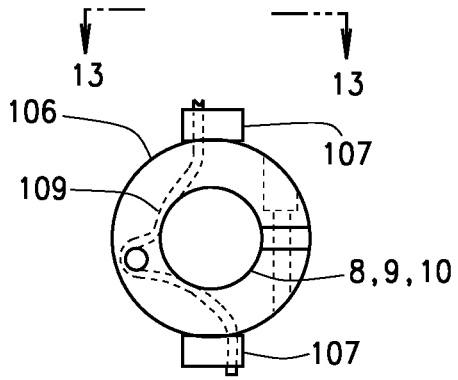
FIG. 12 has an end view of a piston connecting rod rotator.
Figure 13:
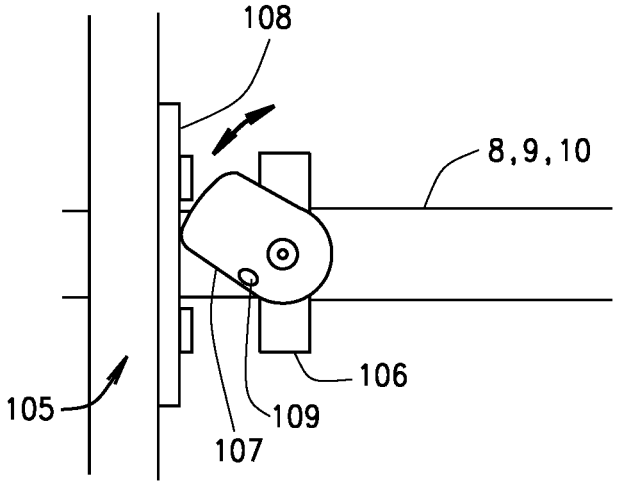
FIG. 13 shows an elevation of a piston connecting rod rotator.

FIG. 12 and FIG. 13 shows a connecting rod/piston rotator. There is a benefit for a piston moving horizontally to be rotated to even the wear on the piston seals. A piston moving vertically reduces a non-concentric wear on the piston seals. A connecting rod/piston rotator consisting of a collar 106 mounted around a connecting rod 8, 9, 10 which connects to a piston. The collar 106 has lever(s) 107 on the collar that when a lever contacts a material (which may be flexible) 108, at the end of a stroke moves the lever(s) placing a rotational force on the collar rotating the connecting rod/piston. A spring/stop 109, a flexible material connected to the collar and to the lever(s) is used to maintain the lever(s) in an optimal angled position when not in contact with the material 108.

Combustion Chamber Cylinder and Expansion Chamber Cylinder Heat Shield

Figure 14:
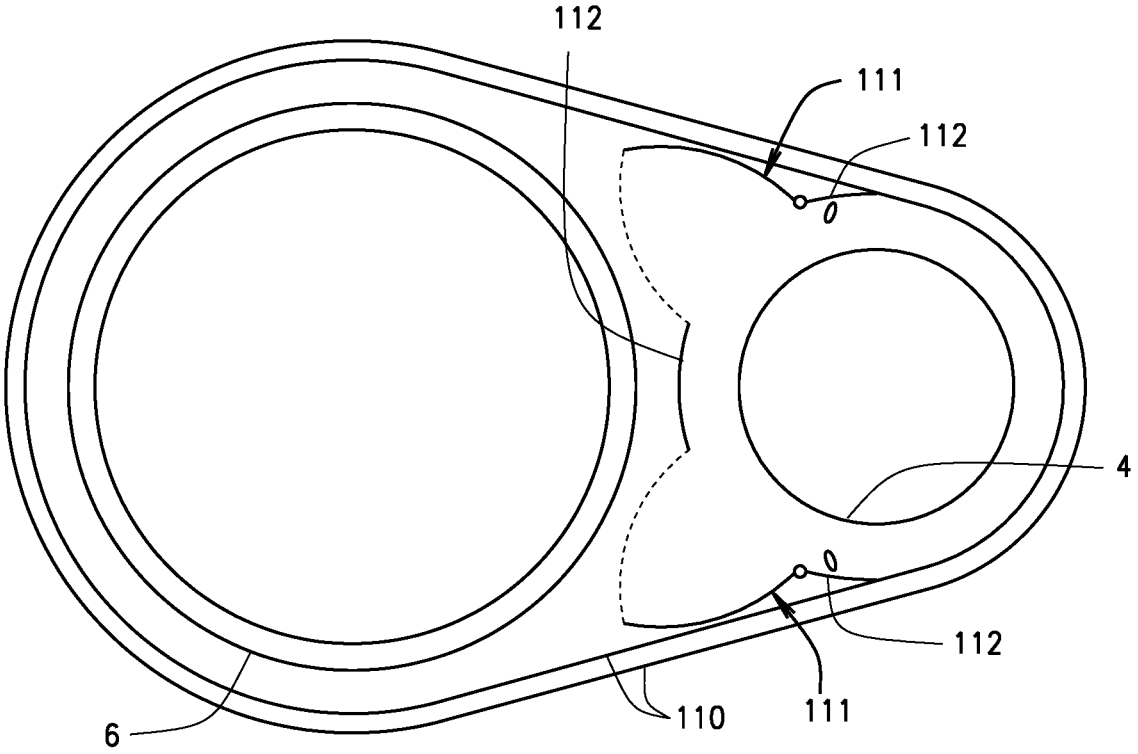
FIG. 14 show a sectional view thru combustion chamber cylinder and expansion chamber cylinder heat shield with interior operable vents.

FIG. 14 shows a heat shield 110 made up of at least one layer of sheet material. The combustion chamber cylinder 4 and expansion chamber cylinder 6 are shown contained in the interior of the heat shield 110. This engine has a heat shield to encase the combustion chamber cylinder and in a preferred engine the expansion chamber cylinder. Preferred is a multi-layered sheet metal heat shielding. Internal baffling 112 and internal and external operable vents 111 may be incorporated to control temperatures. The heat from the combustion chamber cylinder is transferred to the expansion chamber cylinder as required to maintain the combustion chamber cylinder/piston seals at a temperature the materials maintain structural integrity.

Machining the Chamber Walls

Figure 15:
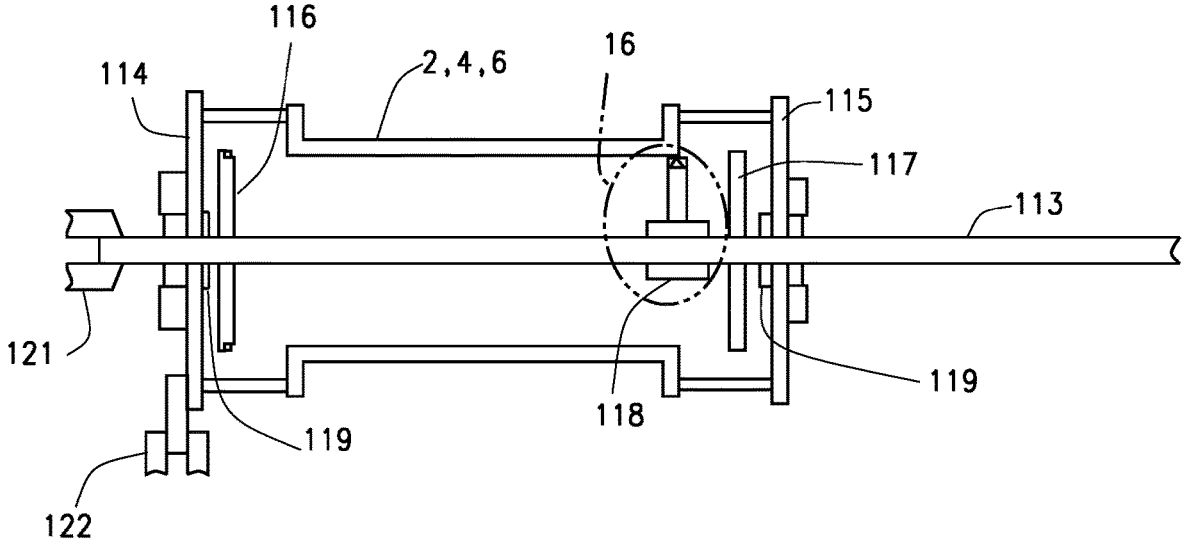
FIG. 15 has a sectional view thru a mechanism for machining a chamber cylinder; and, FIG. 16 shows an isometric of an attachment of a tool bit holder to a shaft.
Figure 16:
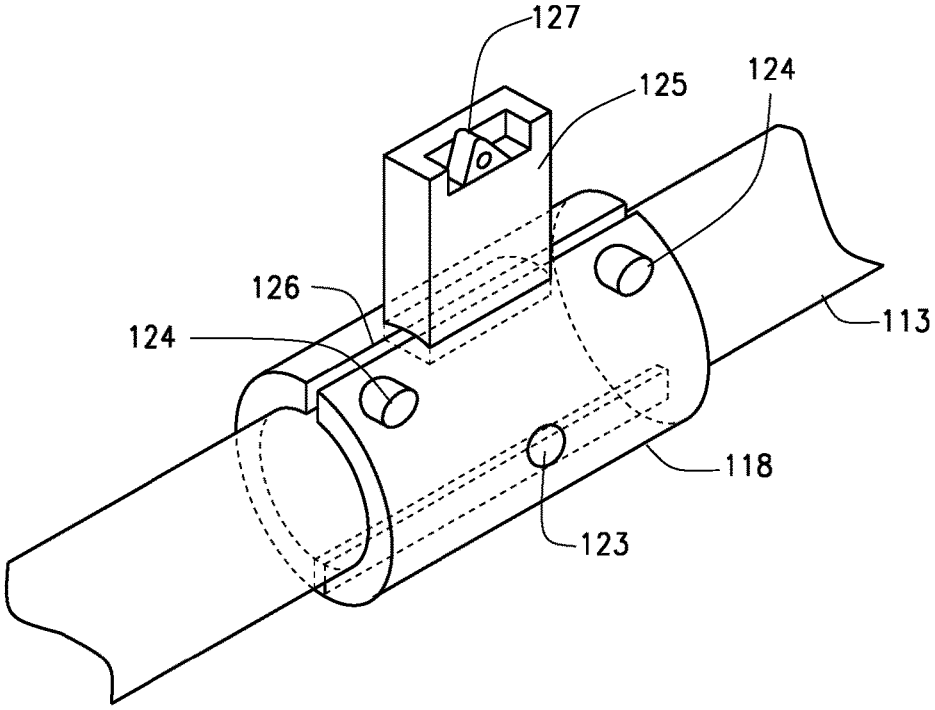

FIG. 15 shows a mechanism for machining the interior chamber cylinder sealing surface. FIG. 16 shows an attachment part for connecting a tool bit holder to a shaft 113. Machining relatively long chambers with thin chamber walls is an integral issue to the feasibility of this engine, or for use in other purposes. The material used in this engine's chamber walls needs to maintain structural stability at high temperatures without scaling, these tend to be hard materials which compound the difficulty in machining. Chamber walls are required to be a tight tolerance to reduce blow by of combustion gasses past the piston seals. A way to accomplish machining of a cylinder wall is to attach a bearing support structure 114 and 115 to each end of the chamber cylinder 2, 4 or 6, the bearing support structures are offset from the ends of the chamber cylinder by means of spacers integral, or separate, from the bearing support structure. Bolts or clamps may be the connecting means. The bearing support structures attached to the ends of the chamber cylinder move on the shaft 113. The bearing support structures are centered by a centering means such as round disks 116, 117 at each end of the chamber cylinder, the center of each disk matches the shaft 113 diameter and the outer edge is stepped/tapered to push into the end of the chamber cylinder 2, 4 or 6, once the bearing support structures are centered they are tightened it place one to each end of the chamber cylinder then the centering disks are pushed out to the bearing support structures. The centering disk or means each may be designed to be able to be taken apart for removal. A shaft 113 spans between the bearings in the bearing support structures and further out the ends, the shaft has an attachment part 118 for a tool bit holder or an attachment part 118 for a grinder holder. The holder may be inserted directly into a slot in the shaft and not have the attachment piece. The shaft is turned so it and the attachment part for the tool bit holder, the tool bit holder with a tool bit is moved around and along relative to the chamber cylinder to machine the inner chamber cylinder wall surface. This can be a metal turning lathe chuck 121 turning the shaft and associated parts as the metal lathe tool holder 122 moves the chamber cylinder with bearing support structures at each end down the shaft with the attachment part for the tool bit holder, the tool bit holder and tool bit cut the inner surface of the chamber wall. The connection between the metal lathe tool holder 122 that is connected to the chamber cylinder may be a semi ridged connection. A seal 119 is attached to the bearing or the bearing support structure and sized for the shaft to keep debris away from the surface in contact with the shaft bearing.

After each pass the tool bit holder is moved out, by removing the tool bit holder 125, as shown in FIG. 16, and placing a spacer(s) 126 or longer tool bit holder and then retightening the attachment part for the tool bit holder that holds the tool bit 127, a screw, gear/servo motor may be developed to move the tool bit holder. The first pass(s) can be a pointed edge of the tool bit, the last pass(s) the flat edge of the tool bit. The attachment piece may be made of multiple pieces to be able to tighten the tool bit holder by screws 124 then tighten screws on the other side to tighten the attachment piece to the shaft. A screw 123 prevents rotation of the attachment piece upon the shaft. Meanwhile, the shaft 113 has an attachment part 118 for the tool bit holder and then permits retightening the attachment part by screw 124. The attachment part 118 holds the tool bit holder that for the tool bit 127.

An engine may have fewer or more components described in this document.

As such, those skilled in the art will appreciate that the conception, upon which this disclosure is based, may readily be utilized as a basis for the designing of other structures, methods and systems for carrying out several purposes of the present invention. Therefore, the claims include such equivalent constructions insofar as they do not depart from the spirit and the scope of the invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

I claim:

1. An engine driving a rotating output shaft having an axis of rotation, comprising:

an air compressor cylinder with a piston, and a combustion chamber cylinder with a second piston;

a port connecting said air compressor cylinder and said combustion chamber cylinder, said port providing direct gaseous communication between said air compressor cylinder and said combustion chamber cylinder;

said piston and said second piston each having a connecting rod and connecting rod heads;

said piston and said second piston and connecting rods having a linear movement;

two fuel compressor chamber cylinders each with a third piston, said third pistons each moving in an opposite cycle, said fuel compressor chamber cylinders being mutually linearly offset;

said third pistons each moving in the same linear motion and for the same length of motion as said connecting rods and said connecting rod heads of said piston and said second piston; and said air compressor cylinder, said combustion chamber cylinder, and said fuel compressor cylinders being arranged adjacent and mutually parallel and wherein said air compressor cylinder, said combustion chamber cylinder, and said fuel compressor cylinders are adapted to be perpendicular to the axis of rotation of the output shaft.

2. The engine of claim 1 further comprising:

said combustion chamber cylinder having an igniting burner, a motorized air/fuel mixture pump, and a main burner;

said igniting burner receiving a pressurized air fuel mixture from said motorized air/fuel mixture pump and having an ignition means; and said main burner mixing and injecting an air/fuel mixture beyond said igniting burner into said combustion chamber cylinder.

3. The engine of claim 1 further comprising:

said head having a plurality of layers of material forming an enclosure and ports; and said layers of material having a flexible gasket material therebetween.

4. The engine of claim 1 further comprising:

said engine having an expansion chamber cylinder with a fourth piston, said expansion chamber cylinder having a port connection to said combustion chamber cylinder with said second piston;

said second piston having a connecting rod and a connecting rod head being 180 degrees out of phase of and between said piston of said air compressor cylinder, said piston having a connecting rod and a connecting rod head on one side and said fourth piston having a connecting rod and connecting rod head on the other side; and said second piston having a connecting rod and a connecting rod head being weighted to balance said connecting rod and said connecting rod head of said piston and said piston and said connecting rod and said connecting rod head of said fourth piston and said fourth piston.

5. The engine of claim 1 further comprising:

a heat shield containing said combustion chamber cylinder and said expansion chamber cylinder; and said engine guiding flow of air around said combustion chamber cylinder and said expansion chamber cylinder.

6. An engine driving a rotating output shaft having an axis of rotation, comprising:

an air compressor cylinder with a piston, and a combustion chamber cylinder with a second piston;

a port connecting the air compressor cylinder and the combustion chamber cylinder, said port providing direct gaseous communication between said air compressor cylinder and said combustion chamber cylinder;

said piston and said second piston each having a connecting rod;

said piston, said second piston, and said connecting rods each having a linear movement;

a plurality of seals having an outer shape registering to an interior surface of said combustion chamber cylinder, an outer side, and an inner surface, and each of said seals having an end, each of said seals being carbon based and is adapted to self-lubricate;

said piston and said second piston each connecting solidly to a connecting rod;

said second piston having retainers each holding at least one of said seals between nearly parallel planes wherein each of said retainers is rotated about 90 degrees relative to each other and retains said seals and wherein said seals overlap at their ends;

said second piston having said seals to said combustion chamber cylinder extending outwardly from center of said second piston to said chamber cylinder;

said second piston having a mechanism moving said seals to said combustion chamber cylinder;

said second piston having outer surface material containing an outer side of one of said seals and said retainer containing an inner surface of one of said seals; and said air compressor cylinder and said combustion chamber cylinder being arranged adjacent and mutually parallel and wherein said air compressor cylinder and said combustion chamber cylinder are adapted to be perpendicular to the axis of rotation of the output shaft.

7. The engine of claim 6 further comprising:

a rotator mechanism having a lever maintaining structure connecting to at least one of said connecting rods; and a flexible plate wherein upon when said lever contacts said flexible plate, said lever moves and said lever through said structure rotates at least one of said connecting rods.

8. The engine of claim 6 further comprising:

said head having a plurality of layers of material forming an enclosure and ports; and said layers of material having a flexible gasket material therebetween.

9. The engine of claim 8 wherein said layers of material are metallic and metallic alloy, and wherein said flexible gasket material is carbon based.

10. The engine of claim 9 wherein said layers of material are one of steel, nickel plated steel, stainless steel alloy, high temperature nickel based super alloy, and silicon carbide.

11. The engine of claim 9 wherein said flexible gasket material is one of graphite and graphite stainless steel composite.

12. The engine of claim 6 further comprising:

said engine having an expansion chamber cylinder with a fourth piston, said expansion chamber cylinder having a port connection to said combustion chamber cylinder with said second piston;

said second piston having a connecting rod and a connecting rod head being 180 degrees out of phase of and between said piston of said air compressor cylinder, said piston having a connecting rod and a connecting rod head on one side and said fourth piston having a connecting rod and connecting rod head on the other side; and said second piston having a connecting rod and a connecting rod head being weighted to balance with said piston of said air compressor cylinder.

13. The engine of claim 6 further comprising:

a heat shield containing said combustion chamber cylinder and said expansion chamber cylinder; and said engine guiding flow of air around said combustion chamber cylinder and said expansion chamber cylinder.

14. An engine driving a rotating output shaft having an axis of rotation, comprising:

an air compressor cylinder with a piston, and a combustion chamber cylinder with a piston;

a port connecting said air compressor cylinder and said combustion chamber cylinder, said port providing direct gaseous communication between said air compressor cylinder and said combustion chamber cylinder;

said pistons each having a connecting rod;

said pistons and said connecting rods each having a linear movement;

a valve mechanism moving at least one valve, said valve mechanism having a continuous loop, of one of chain and belt, connecting two rotational components, said at least one valve having an open position and a closed position;

said valve mechanism having at least one valve gear, at least two valve gear segments, at least one valve crank, at least one connecting rod, at least one rocker, and said at least one valve;

said valve mechanism having more than one of said valve gear segment attaching to said continuous loop, said at least two valve gear segments engaging said at least one valve gear at intervals, said at least one valve gear connecting to said at least one valve crank, a valve connecting rod connecting to said at least one valve crank and said at least one rocker, said at least one rocker connected to said at least one valve;

said at least two valve gear segments attaching to said continuous loop, one of said at least two valve gear segments being timed to operate said valve mechanism to close a valve before top dead center of either of said pistons and a second of said at least two valve gear segments being timed to operate said valve mechanism to open a valve at or near bottom dead center of either of said pistons;

said valve operating mechanism having said at least two valve gear segments engaging said at least one valve gear at intervals turning said at least one valve gear 180 degrees on each passage of one of said valve gear segments; and said air compressor cylinder and said combustion chamber cylinder being arranged adjacent and mutually parallel and wherein said air compressor cylinder and said combustion chamber cylinder are adapted to be perpendicular to the axis of rotation of the output shaft.

15. The engine of claim 14 further comprising:

a non-concentric exhaust valve having a valve stem;

said exhaust valve stem having a hole;

said exhaust valve stem hole receiving an insertable pin; and said insertable pin fitting in a slot wherein said exhaust valve stem follows a linear non-rotational motion.

16. The engine of claim 14 further comprising:

said valve operating mechanism having a position maintaining mechanism that engages at said open position of said valve and at said closed position of said valve.

17. The engine of claim 14 further comprising:

said head having a plurality of layers of material forming an enclosure and ports; and said layers of material having a flexible gasket material therebetween.

18. The engine of claim 14 further comprising:

said engine having an expansion chamber cylinder with a piston, said expansion chamber cylinder having a port connection to said combustion chamber cylinder with said piston;

said piston having a connecting rod and a connecting rod head being 180 degrees out of phase of and between said piston of said air compressor cylinder, said piston having a connecting rod and a connecting rod head on one side and said piston having a connecting rod and connecting rod head on the other side; and said piston having a connecting rod and a connecting rod head being weighted to balance the engine when running.

19. The engine of claim 14 further comprising:

a heat shield containing said combustion chamber cylinder and said expansion chamber cylinder; and said engine guiding flow of air around said combustion chamber cylinder and said expansion chamber cylinder.

20. An engine driving a rotating output shaft having an axis of rotation, comprising:

an air compressor cylinder with a piston, and a combustion chamber cylinder with a second piston;

a port connecting said air compressor cylinder and said combustion chamber cylinder, said port providing direct gaseous communication between said air compressor cylinder and said combustion chamber cylinder;

said piston and said second piston each having a connecting rod and connecting rod heads;

said piston and said second piston and connecting rods having a linear movement;

two fuel compressor chamber cylinders each with a third piston, said third pistons each moving in an opposite cycle, said fuel compressor chamber cylinders being linearly offset;

said third pistons each moving in the same linear motion and for the same length of motion as said connecting rods and said connecting rod heads of said piston and said second piston;

said engine having an expansion chamber cylinder with a fourth piston, said expansion chamber cylinder having a port connection to said combustion chamber cylinder with said second piston;

said second piston having a connecting rod and a connecting rod head being 180 degrees out of phase of and between said piston of said air compressor cylinder, said piston having a connecting rod and a connecting rod head on one side and said fourth piston having a connecting rod and connecting rod head on the other side;

said second piston having a connecting rod and a connecting rod head being weighted to balance said connecting rod and said connecting rod head of said piston and said piston and said connecting rod and said connecting rod head of said fourth piston and said fourth piston; and said air compressor cylinder and said combustion chamber cylinder being arranged adjacent and mutually parallel and wherein said air compressor cylinder and said combustion chamber cylinder are adapted to be perpendicular to the axis of rotation of the output shaft.

* * * * *